US008999010B2

(12) United States Patent
Allison

(10) Patent No.: US 8,999,010 B2
(45) Date of Patent: Apr. 7, 2015

(54) TRANSPARENT GEL CANDLE BASE

(75) Inventor: Gerald Allison, East Windsor, NJ (US)

(73) Assignee: Firmenich SA, Geneva (CH)

( * ) Notice: Subject to any disclaimer, the term of this patent is extended or adjusted under 35 U.S.C. 154(b) by 296 days.

(21) Appl. No.: 13/391,991

(22) PCT Filed: Sep. 3, 2010

(86) PCT No.: PCT/IB2010/053968

§ 371 (c)(1),
(2), (4) Date: Feb. 23, 2012

(87) PCT Pub. No.: WO2011/030265

PCT Pub. Date: Mar. 17, 2011

(65) Prior Publication Data

US 2012/0148965 A1 Jun. 14, 2012

Related U.S. Application Data

(60) Provisional application No. 61/240,495, filed on Sep. 8, 2009.

(51) Int. Cl.
*C11C 5/00* (2006.01)

(52) U.S. Cl.
CPC ..... *C11C 5/002* (2013.01)

(58) Field of Classification Search
CPC ..... C08L 91/00; C08L 5/002; C08L 5/008
USPC ..... 44/275
See application file for complete search history.

(56) References Cited

U.S. PATENT DOCUMENTS

| | | | | |
|---|---|---|---|---|
| 5,843,194 | A | 12/1998 | Spaulding | 44/275 |
| 6,478,830 | B2 | 11/2002 | Allison et al. | 44/275 |
| 7,244,419 | B2 * | 7/2007 | Yamato et al. | 424/67 |
| 8,617,525 | B2 * | 12/2013 | Yoshida et al. | 424/63 |
| 2005/0100572 | A1 | 5/2005 | Hatajima et al. | 424/401 |
| 2005/0208085 | A1 | 9/2005 | Yamato et al. | 424/401 |

OTHER PUBLICATIONS

INDIOGEL, Oil Gelling agent, date unknown.*
International Search Report and Written Opinion mailed Feb. 3, 2011, Application No. PCT/IB2010/053968 filed Sep. 3, 2010.

* cited by examiner

*Primary Examiner* — Cephia D Toomer
(74) *Attorney, Agent, or Firm* — Winston & Strawn LLP

(57) ABSTRACT

The present invention relates to transparent gel candle bases that may be used as a base material of transparent candles, to the transparent candles made therefrom, and to methods of making such candle bases and candles. The transparent gel candle bases of the present invention include a hydrocarbon oil and a gelling agent comprising dibutyl lauroyl glutamide and dibutyl ethylhexanoyl glutamide.

20 Claims, No Drawings

TRANSPARENT GEL CANDLE BASE

This application is a 371 filing of International Patent Application PCT/IB2010/053968 filed Sep. 3, 2010, which claims the benefit of application No. 61/240,495 filed Sep. 8, 2009.

TECHNICAL FIELD

The present invention relates to transparent gel candle bases that may be used as a base material of transparent candles, to the transparent candles made therefrom, and to methods of making such candle bases and candles. The transparent gel candle bases of the present invention include a hydrocarbon oil and a gelling agent comprising dibutyl lauroyl glutamide and dibutyl ethylhexanoyl glutamide.

PRIOR ART

Burning a candle involves a process that imposes rather stringent requirements upon the candle body material in order to be able to maintain a flame, avoid surface pool ignition, and prevent excessive dripping or the candle body melting. When a candle is burnt, the heat of the candle's flame melts a small pool of the candle body material around the base of the exposed portion of the wick. This molten material is then drawn up through and along the wick by capillary action to fuel the flame. In order to meet the stringent requirements that the candle's body material must possess, the candle should liquefy at or below temperatures to which the candle's material can be raised by radiant heat from the candle flame. If too high a temperature is required to melt the body material, the flame will be starved because insufficient fuel will be drawn up through the wick, resulting in the flame being too small to maintain itself. On the other hand, if the candle's melting temperature is too low, the candle will drip or, in an extreme case, the entire candle body will melt, dropping the wick into a pool of molten body material, with the potential that the surface of the pool could ignite. Additionally, in order to meet the stringent requirements upon the candle body material, when molten, the material should have a relatively low viscosity to ensure that the molten material will be capable of being drawn up through the wick by capillary action. Additional desired features may place still further demands on these already stringent requirements. For example, it is generally desirable that the candle body material burn with a flame that is both luminous and smokeless, and that the odors produced by its combustion should not be unpleasant. These features require that the composition used to make such candles meet even further physical requirements. Additionally, when transparent candles are desired, additional physical requirements must be met by the composition used to make such candles.

Candle bases that are presently known for making transparent candles typically have one or more undesirable characteristics. In particular, such candle bases typically do not have enough rigidity to form a self-supporting candle, and require some type of container or external support. Such container candles generally additionally possess undesirable characteristics such as the potential shifting of the gel from which they are made, for example during shipping. Improving the hardness of the candle base is therefore still desirable. Candle bases for making transparent candles also typically have an undesirable gelatinous or oily feeling. In addition, such candle bases may darken or smoke during burning, which is aesthetically undesirable. Candles made from transparent candle bases may also exhibit undesired external cracking and/or internal fractures. It is also advantageous to continuously improve transparency of transparent candles.

U.S. Pat. No. 5,843,194 describes transparent candle compositions in the form of gels which include hydrogenated polyolefins and at least one derivative of a N-acyl amino acid as gelling agent. Dibutyl lauroyl glutamide is cited in a list of possible N-acyl amino acid derivatives.

U.S. Pat. No. 6,478,830 describes compositions for use in the preparation of candles comprising a liquid base material, a specific type of polymer and at least one derivative of a N-acyl amino acid, among which dibutyl lauroyl glutamide is cited. The compositions described in this document are in the form of gel compositions which solidify upon cooling.

However, the candle bases described in the documents cited above are characterized by insufficient transparency and hardness. Therefore, there is a need to provide further transparent candles made of gel and having improved properties. In particular, it is desirable to provide a gel candle with improved transparency and hardness. It would be further desirable to provide such candles, which at the same time fulfil all requirements of safe and pleasant burning, as detailed above. It would also be desirable to provide transparent gel candles which may comprise a wide variety of oils. Indeed, diverse types of oils may be used to prepare candles, depending on the candle type. The present invention addresses and solves these problems.

DETAILED DESCRIPTION OF THE INVENTION

The present inventors have solved the above mentioned problems by providing a specific gelling agent comprising a combination of dibutyl lauroyl glutamide and dibutyl ethylhexanoyl glutamide, which significantly improved the structural qualities of transparent gel candle bases, in particular transparency and hardness of such gels, and also contributed to the reduction of oil exudation. Transparent gel candles based on such gel candle bases are additionally characterized by satisfying burning properties.

The invention therefore provides a transparent gel candle base in the form of a gel composition comprising a hydrocarbon oil and a gelling agent comprising dibutyl lauroyl glutamide and dibutyl ethylhexanoyl glutamide.

As a "gel candle base" it is meant here any gel composition which can be used to form candles.

The term "transparent" is used herein to connote a substantial absence of cloudiness or obscurity, so that the body of a candle made of a "transparent" gel features an ability to let light pass through in a substantially unobstructed manner and has a high degree of transparency, with little or no cloudiness or haze. Decorative materials may be among the optional additives to the gels and candles of the present invention, which those skilled in the art would recognize as potentially obstructing light from passing through certain portions of the gels and candles. However, such gels or candles would nevertheless be included among those described as "transparent" herein, if the portions of the candle or gel that do not contain such decorative materials would be otherwise considered transparent. Preferably, transparent gels or candles of the present invention have a degree of clarity, which is most preferably comparable to window glass, transparent glassware, or water. More preferably, the "transparent" gels or candles of the present invention have a transmittance of at least 80%, more preferably at least 85%, and even more preferably at least 90%, as measured spectrophotometrically using water as a standard (100% transmittance) at 690 nm.

As pointed out above, dibutyl lauroyl glutamide is known to be sufficient in itself to gel most oils but it does not provide enough transparency and hardness, even when used at high levels. Similarly, we have been able to ascertain that when dibutyl ethylhexanoyl glutamide is used as single gelling agent, it provides cloudy gels with most oils and even in gels which are partially clear, exudation and excessive sooting is observed. However, we have now observed unexpectedly that these two components act synergistically as gelling agent with the effect of significantly improving the transparency and hardness of the gel candle bases to which they are added. Exudation will also be reduced by the use as gelling agent of a combination of dibutyl lauroyl glutamide and dibutyl ethylhexanoyl glutamide.

The use of a combination of dibutyl lauroyl glutamide and dibutyl ethylhexanoyl glutamide as a gelling agent to produce a transparent gel candle base is therefore an important aspect of the present invention.

Dibutyl lauroyl glutamide and dibutyl ethylhexanoyl glutamide are both available commercially. For example, dibutyl lauroyl glutamide can be obtained under the trade-name GP-1 from Ajinomoto Co, Tokyo, Japan. Dibutyl ethylhexanoyl glutamide can be obtained from the same company, under the trade-name EB-21.

Dibutyl lauroyl glutamide and dibutyl ethylhexanoyl glutamide, taken together, are typically present in an amount of from 0.5 to 10% by weight, relative to the total weight of the gel candle base. When the transparent gel candle base is intended to be used to form container candles, the total amount of dibutyl lauroyl glutamide and dibutyl ethylhexanoyl glutamide is preferably comprised between 1 and 5% by weight, more preferably between 2 and 5% by weight, relative to the total weight of the gel candle base. To form free-standing candles, the total amount of dibutyl lauroyl glutamide and dibutyl ethylhexanoyl glutamide is preferably comprised between 4 and 10% by weight, relative to the total weight of the gel candle base.

Dibutyl lauroyl glutamide and dibutyl ethylhexanoyl glutamide are preferably present in concentrations ranging from 0.5 to 5% each, preferably from 0.5 to 4% each, more preferably from 0.5 to 2.5% each, most preferably from 1 to 2.5% each. These percentages are defined by weight, relative to the total weight of the candle base.

According to a preferred embodiment of the invention, the gelling agent comprises dibutyl lauroyl glutamide and dibutyl ethylhexanoyl glutamide in a relative ratio comprised between 1:1 and 2.5:1, respectively, preferably in a relative ratio comprised between 1:1 and 1.5:1, respectively.

In addition to the specific combination of dibutyl lauroyl glutamide and dibutyl ethylhexanoyl glutamide described above, the gelling agent may also contain additional components which are known to the skilled person as having a gelling effect. Examples of such optional additional components are N-acyl amino acid derivatives such as N-acyl amino acid amides and N-acyl amino acid esters prepared from glutamic acid, lysine, glutamine, aspartic acid and mixtures thereof. Non-limiting examples of N-acyl amino acid derivatives that may be used as optional additional gelling agents include N-lauroyl-glutamic acid diethyl amide, N-lauroyl-glutamic acid dihexyl amide, N-lauroyl-glutamic acid dioctyl amide, N-lauroyl-glutamic acid didecyl amide, N-lauroyl-glutamic acid didodecyl amide, N-lauroyl-glutamic acid ditetradecyl amide, N-lauroyl-glutamic acid dihexadecyl amide, N-lauroyl-glutamic acid distearyl amide, N-stearoyl-glutamic acid dibutyl amide, N-stearoyl-glutamic acid dihexyl amide, N-stearoyl-glutamic acid diheptyl amide, N-stearoyl-glutamic acid dioctyl amide, N-stearoyl-glutamic acid didecyl amide, N-stearoyl-glutamic acid didodecyl amide, N-stearoyl-glutamic acid ditetradecyl amide, N-stearoyl-glutamic acid dihexadecyl amide, N-stearoyl-glutamic acid distearyl amide and mixtures thereof.

In a preferred embodiment of the invention, the gelling agent consists of dibutyl lauroyl glutamide and dibutyl ethylhexanoyl glutamide.

The gelling agent can be used to gel any type of hydrocarbon oils. Examples of preferred hydrocarbon oils include vegetable oils, hydrogenated vegetable oils, petroleum derived oils, synthetic oils, phthalate esters and fatty acid esters.

Vegetable oils derived from plants are particularly preferred. Examples of such vegetable oils are olive oil, castor oil, sweet almond oil, safflower oil, apricot oil and grapeseed oil. Olive oil is particularly appreciated for its clean burning properties. Castor oil is also advantageously used, especially to control the dissolution temperature and the final melt point of the finished candle base.

As an example of suitable hydrogenated vegetable oils one can cite a mixture of caprylic and capric triglycerides such as that sold by Stepan under the tradename Neobee®.

Petroleum derived oils have the advantage of reducing exudation. Examples of particularly appreciated petroleum derived oils and synthetic oils comprise mineral oils (such as for example that sold by Penreco under the tradename Drakeol®), paraffins, isoparaffins (such as those sold by ExxonMobil under the tradename Isopar™, preferably Isopar™ V and M), alpha olefins and polyalpha olefins.

As examples of preferred phthalate esters, one can cite isoheptyl phthalate, diisononyl phthalate and diethyl phthalate. Examples of fatty acid esters include isostearyl alcohol and isostearic acid.

The hydrocarbon oil is preferably non-volatile and non-polar. The term "non-volatile" as used herein refers to materials which exhibit a vapour pressure of no more than about 0.2 mm Hg at 25° C. and 1 atm and/or to materials which have a boiling point at 1 atm greater than 230° C.

The hydrocarbon oil is typically present in the candle bases of the present invention in an amount of from 65% to 99.5% by weight, preferably between 80 and 99% by weight, relative to the total weight of the gel candle base. Within this range, the preferred amount varies depending on whether the candle base will be used to form a free-standing candle or a container candle. For forming a free-standing candle, preferably the hydrocarbon oil is present in the candle base in an amount of about 80% to about 96% by weight, and even more preferably about 80% to about 90% by weight. For forming a container candle, preferably the hydrocarbon oil is present in the candle base in an amount of about 80% to about 99% by weight.

Polar molecules such as fatty acids, fatty alcohols and glycols may optionally be added to the transparent gel candle bases of the present invention, in order to adjust the melting point and dissolution temperature of the gel. Indeed, these compounds are capable of lowering the melting point of the gel candle base as desired, for technical and/or security reasons. In particular the burning rate of the candle can be adjusted by adding glycols such as hexylene glycol, or fatty alcohols, such as isostearyl alcohol, to the candle base. The skilled person is able to select the types and amounts of such compounds on the basis of his general knowledge.

To prevent exudation, it is particularly appreciated to add 12-hydroxystearic acid or emollients such as ELDEW PS 203 (phytosteryl/octoyldodecyl/lauroyl glutamate, origin Ajinomoto Co., Tokyo, Japan) as optional ingredient in the transparent gel candle bases of the present invention.

The candle bases of the present invention may optionally include one or more additional components to produce candles having enhanced or additional aesthetic and/or functional improvements. In particular, the additional materials that may be included in the candle bases include perfumes, malodor counteractants, antibacterial agents, coloring agents, decorative materials, insect repellants, solvents, stabilizers, antioxidants, and UV blockers.

Among optional ingredients, it is particularly advantageous to add a perfume, an insect repellent, an antibacterial agent and/or a malodor counteractant, most preferably a perfume, to the transparent gel candle base of the invention.

By the term "malodor counteractant" or "malodor counteracting ingredient" we mean here compounds which are capable of reducing the perception of malodor, i.e. of an odor that is unpleasant or offensive to the human nose by counteracting and/or masking malodors. In a particular embodiment, these compounds have the ability to react with key compounds causing known malodors. The reactions result in reduction of the malodor materials' airborne levels and consequent reduction in the perception of the malodor.

Non-limiting examples of suitable insect repellants include citronella, dimethyl phthalate and n,n-dimethyl-m-tolumide.

As "perfume" one may use any perfuming ingredient or a mixture thereof. A "perfuming ingredient" is meant here as a compound which is of current use in the perfumery industry, i.e. a compound which is used as active ingredient in perfumed candles in order to impart a hedonic effect into its surrounding. In other words, such an ingredient or mixture, to be considered as being a perfuming one, must be recognized by a person skilled in the art of perfumery as being able to impart or modify in a positive or pleasant way the odor of a candle, and not just as having an odor. Moreover, this definition is also meant to include compounds that do not necessarily have an odor but are capable of modulating the odor of a perfuming composition or of a perfumed candle and, as a result, of modifying the perception by a user of the odor of such a composition or candle.

The nature and type of these perfuming ingredients do not warrant a more detailed description here, which in any case would not be exhaustive, the skilled person being able to select them on the basis of his general knowledge, the intended use or application and the desired organoleptic effect. In general terms, these perfuming ingredients belong to chemical classes as varied as alcohols, aldehydes, ketones, esters, ethers, acetates, nitriles, terpene hydrocarbons, nitrogenous or sulphurous heterocyclic compounds and essential oils, and said perfuming ingredients can be of natural or synthetic origin. Many of these ingredients are in any case listed in reference texts such as the book by S. Arctander, Perfume and Flavor Chemicals, 1969, Montclair, N.J., USA, or its more recent versions, or in other works of a similar nature, as well as in the abundant patent literature in the field of perfumery. It is also understood that said ingredients may also be compounds known to release in a controlled manner various types of perfuming compounds.

In a preferred embodiment of the invention, and in order to optimize the structural properties of the transparent gel candle base of the invention, the perfume preferably contains at most 30%, more preferably at most 20%, of aromatic and primary alcohols, the percentages being defined by weight relative to the total weight of the perfume. On the other hand, cyclic and benzylic compounds (except alcohols) have advantageous effects on the gel structure and on the burning properties of candles made thereof.

The perfume is typically present in an amount of 1 to 15%, preferably 5 to 15%, most preferably 5 to 10%, by weight, relative to the total weight of the transparent gel candle base.

The other optional ingredients do not warrant a more detailed description here, which would in any case not be exhaustive. The skilled person is capable to select them on the basis of his general knowledge and the desired characteristics of the candle base. In particular, the kind and amount of the additional ingredients are selected among those that do not alter the transparency of the gel candle base, that do not induce cloudiness or haze in the gel, do not darken or smoke when a candle made of the gel candle base is burning and do not alter the rigidity of the candle.

One of the principal advantages of the gel candle base of the invention is its hardness. The candle base is therefore preferably characterized by a needle penetration point measurement ranging from 50 to 250 mm, even more preferably from 150 to 250 mm as measured using the ASTM D1321 method at 25° C.

As stated above, it is also an advantage of the present invention to have good burning properties. In particular, the transparent gel candle base of the invention is preferably characterized by a melting point ranging between 70 and 110° C., even more preferably between 80 and 100° C.

It is further advantageous that the transparent gel candle base is thermoreversible. In other terms, when a candle formed of a transparent gel candle base according to the invention is extinguished, it is desirable that the pool of melted candle base formed upon burning solidifies without significant change to the properties of the gel base.

Other advantageous properties of the gel candle bases of the invention are the following: they do not crack or split during burning or suffer from syneresis; they have a wide pool, which provides a greater fragrance throw and helps avoid tunnelling; they do not have an undesirable gelatinous or oily feel to the touch; and they retain structural integrity while burning.

In another aspect, the invention provides transparent candles comprising the transparent gel candle base of the invention and at least one wick.

The at least one wick is formed of any wicking material known to the person skilled in the art. Examples of preferred wicks contain a paper core which have been observed to provide the most desired combination of burn characteristics, especially with respect to attributes such as smoke, bloom, fragrance throw and burn rate. However, other types of suitable wicks known to those in the art, may also be used in accordance with the present invention. Non-limiting examples of suitable wicks and wicking materials known to those skilled in the art are commercially available from Atkins-Pearce of Covington, Ky., USA.

The transparent candles of the invention include all kinds of candles which may be either free standing candles or candles formed into a container. Non-limiting examples of suitable candle types include container candles, pillar candles, votives, tapers, candle potpourri diffusers and tart warmers. Preferred candles according to the invention are container candles In another embodiment, the invention provides a method for the production of a transparent gel candle base or of a transparent candle wherein there is used a combination of dibutyl lauroyl glutamide and dibutyl ethylhexanoyl glutamide as gelling agent.

In a preferred embodiment, said method for the production of a transparent gel candle base comprises a) heating a hydrocarbon oil to a temperature sufficient to solubilize the gelling agent of step b) into the hydrocarbon oil; and b) adding to the heated oil a gelling agent comprising dibutyl lauroyl glutamide and dibutyl ethylhexanoyl glutamide.

The components of the base are as described above.

Preferably, the hydrocarbon oil is heated in step a) to a temperature comprised between 85 and 110° C.

In another preferred embodiment, said method for the production of a transparent candle comprises a) heating a hydrocarbon oil to a temperature sufficient to solubilize the gelling agent of step b) into the hydrocarbon oil;
b) adding to the heated oil a gelling agent comprising dibutyl lauroyl glutamide and dibutyl ethylhexanoyl glutamide;
c) cooling the base to about 75-110° C.;
d) pouring the base into a mold or into a container;
e) adding a wick; and
f) cooling the base to ambient temperature to form the candle.

In embodiments where a free-standing candle is being made, the method includes pouring the base into a mold (rather than a container) and after the candle base has cooled, removing the mold. In embodiments where a container candle is being made, the method includes pouring the base into the container, which will hold the candle after the candle base has cooled. The mold or container is selected easily by the person skilled in the art on the basis of his general knowledge and of the desired aesthetic effect.

The gel candle base and the wick are as described above. The wick is added to the candle in a manner known to the person skilled in the art. The wick can be added before or during step f). In other words, the candle base may optionally be cooled as desired before addition of the wick.

The optional ingredients that may be added to the transparent gel candle base of the invention are typically added to the candle base together with the oil in step a) or, alternatively, after or during cooling step c), before the base is poured into the mold or container. This alternative is typically interesting for perfumes, malodor counteractants, insect repellents and antibacterial agents, which are often volatile compounds that may evaporate during the heating of step a).

The process may further comprise an additional and optional step consisting of coating the obtained candle. This is especially desirable for aesthetic reasons. The coating is preferably carried out using an over dipping process.

EXAMPLES

Example 1

Preparation of a Transparent Candle According to the Invention

A transparent gel candle base, Base A, was prepared by mixing the following ingredients in the amounts indicated.

TABLE 1 composition of Base A

| Ingredient | Amount ( %) |
|---|---|
| Drakeol ®19[1)] | 65.0 |
| Olive oil | 18.0 |
| Neobee ®[2)] | 15.0 |
| GP-1[3)] | 1.2 |
| EB-21[4)] | 0.8 |

[1)]Mineral oil, USP Grade, origin: Penreco
[2)]Mixture of caprylic and capric triglycerides, origin: Stepan
[3)]Dibutyl lauroyl glutamide, origin: Ajinomoto Co., Tokyo, Japan
[4)]Dibutyl ethylhexanoyl glutamide, origin: Ajinomoto Co., Tokyo, Japan The Drakeol® 19, olive oil and Neobee® were added to a mixing vessel and heated to 90-110° C. GP-1 and EB-21 were premixed and then added with mixing until the powder was completely dissolved.

A transparent gel candle, Candle A, was then prepared from Base A. The base was cooled to 90-100° C. and poured into a suitable container. A wick was added. The candle was then cooled to ambient temperature.

The physical properties of the gel candle were then determined. The needle penetration, as measured using the ASTM D1321 method at 25° C., was of 230 mm A transmittance of 91.23% was measured with a ColorQuest XE spectrophotometer (origin: Hunter Lab) at 690 nm, using water as standard.

Example 2

Preparation of a Transparent Candle According to the Invention

A transparent gel candle base, Base B, was prepared by mixing the following ingredients in the amounts indicated.

TABLE 2 composition of Base B

| Ingredient | Amount ( %) |
|---|---|
| Olive oil | 98.0 |
| GP-1[1)] | 1.0 |
| EB-21[2)] | 1.0 |

[1)]Dibutyl lauroyl glutamide, origin: Ajinomoto Co., Tokyo, Japan
[2)]Dibutyl ethylhexanoyl glutamide, origin: Ajinomoto Co., Tokyo, Japan The olive oil was added to a mixing vessel and heated to 90-110° C. GP-1 and EB-21 were premixed and then added with mixing until the powder was completely dissolved.

A transparent gel candle, Candle B, was then prepared from Base B. The base was cooled to 90-100° C. and poured into a suitable container. A wick was added. The candle was then cooled to ambient temperature.

The physical properties of the gel candle were then determined. The needle penetration, as measured using the ASTM D1321 method at 25° C., was of 240 mm A transmittance of 90.75% was measured with a ColorQuest XE spectrophotometer (origin: Hunter Lab) at 690 nm, using water as standard.

Example 3

Preparation of a Transparent Candle According to the Invention

A transparent gel candle base, Base C, was prepared by mixing the following ingredients in the amounts indicated.

TABLE 3 composition of Base C

| Ingredient | Amount (%) |
|---|---|
| Castor oil | 12.0 |
| Olive oil | 84.0 |
| 12-hydroxystearic acid | 2.0 |
| GP-1[1)] | 1.0 |
| EB-21[2)] | 1.0 |

[1)]Dibutyl lauroyl glutamide, origin: Ajinomoto Co., Tokyo, Japan
[2)]Dibutyl ethylhexanoyl glutamide, origin: Ajinomoto Co., Tokyo, Japan The castor oil, olive oil and 12-hydroxystearic acid were added to a mixing vessel and heated to 90-110° C. GP-1 and EB-21 were premixed and then added with mixing until the powder was completely dissolved.

A transparent gel candle, Candle C, was then prepared from Base C. The base was cooled to 90-100° C. and poured into a suitable container. A wick was added. The candle was then cooled to ambient temperature.

The physical properties of the gel candle were then determined. The needle penetration, as measured using the ASTM D1321 method at 25° C., was of 230 mm A transmittance of 91.12% was measured with a ColorQuest XE spectrophotometer (origin: Hunter Lab) at 690 nm, using water as standard.

Example 4

Preparation of a Transparent Candle According to the Invention

A transparent gel candle base, Base D, was prepared by admixing the following ingredients in the amounts indicated.

TABLE 4 composition of Base D

| Ingredient | Amount (%) |
|---|---|
| Drakeol ® 19[1)] | 33.0 |
| Neobee ®[2)] | 55.5 |
| Oleic acid | 8.0 |
| GP-1[3)] | 2.5 |
| EB-21[4)] | 1.0 |

[1)]Mineral oil, USP Grade, origin: Penreco
[2)]Mixture of caprylic and capric triglycerides, origin: Stepan
[3)]Dibutyl lauroyl glutamide, origin: Ajinomoto Co., Tokyo, Japan
[4)]Dibutyl ethylhexanoyl glutamide, origin: Ajinomoto Co., Tokyo, Japan The Drakeol® 19, Neobee® and oleic acid were added to a mixing vessel and heated to 90-110° C. GP-1 and EB-21 were premixed and then added with mixing until the powder was completely dissolved.

A transparent gel candle, Candle D, was then prepared from Base D. The base was cooled to 90-100° C. and poured into a suitable container. A wick was added. The candle was then cooled to ambient temperature.

The physical properties of the gel candle were then determined. The needle penetration, as measured using the ASTM D1321 method at 25° C., was of 218 mm A transmittance of 88.15% was measured with a ColorQuest XE spectrophotometer (origin: Hunter Lab) at 690 nm, using water as standard.

Example 5

Preparation of a Transparent Candle According to the Invention

A transparent gel candle base, Base E, was prepared by mixing the following ingredients in the amounts indicated.

TABLE 5 composition of Base E

| Ingredient | Amount (%) |
|---|---|
| Olive oil | 88.0 |
| Neobee ® M 5[1)] | 8.0 |

TABLE 5-continued composition of Base E

| Ingredient | Amount (%) |
|---|---|
| GP-1[2)] | 2.0 |
| EB-21[3)] | 2.0 |

[1)]Mixture of caprylic and capric triglycerides, origin: Stepan
[2)]Dibutyl lauroyl glutamide, origin: Ajinomoto Co., Tokyo, Japan
[3)]Dibutyl ethylhexanoyl glutamide, origin: Ajinomoto Co., Tokyo, Japan The olive oil and Neobee® M 5 were added to a mixing vessel and heated to 90-110° C. GP-1 and EB-21 were premixed and then added with mixing until the powder was completely dissolved.

A transparent gel candle, Candle E, was then prepared from Base E. The base was cooled to 90-100° C. and poured into a suitable container. A wick was added. The candle was then cooled to ambient temperature.

The physical properties of the gel candle were then determined. The needle penetration, as measured using the ASTM D1321 method at 25° C., was of 155 mm A transmittance of 87.83% was measured with a ColorQuest XE spectrophotometer (origin: Hunter Lab) at 690 nm, using water as standard.

Example 6

Preparation of a Transparent Candle According to the Invention

A transparent gel candle base, Base F, was prepared by mixing the following ingredients in the amounts indicated.

TABLE 6 composition of Base F

| Ingredient | Amount (%) |
|---|---|
| Drakeol ® 19[1)] | 2.0 |
| Olive oil | 91.0 |
| Perfume[2)] | 5.0 |
| GP-1[3)] | 1.0 |
| EB-21[4)] | 1.0 |

[1)]Mineral oil, USP Grade, origin: Penreco
[2)]Perfume having a Vanilla note, item n° HGT3520-25B, origin: Firmenich SA, Geneva, Switzerland
[3)]Dibutyl lauroyl glutamide, origin: Ajinomoto Co., Tokyo, Japan
[4)]Dibutyl ethylhexanoyl glutamide, origin: Ajinomoto Co., Tokyo, Japan The Drakeol® 19, olive oil and perfume were added to a mixing vessel and heated to 90-110° C. GP-1 and EB-21 were premixed and then added with mixing until the powder was completely dissolved.

A transparent gel candle, Candle F, was then prepared from Base F. The base was cooled to 85-95° C. and poured into a suitable container. A wick was added. The candle was then cooled to ambient temperature.

The physical properties of the gel candle were then determined. The needle penetration, as measured using the ASTM D1321 method at 25° C., was of 235 mm A transmittance of 90.75% was measured with a ColorQuest XE spectrophotometer (origin: Hunter Lab) at 690 nm, using water as standard.

Example 7

Preparation of a Transparent Candle According to the Invention

A transparent gel candle base, Base G, was prepared by mixing the following ingredients in the amounts indicated.

TABLE 7

| composition of Base G | |
|---|---|
| Ingredient | Amount (%) |
| Sweet almond oil | 39.5 |
| Neobee ® M 5[1)] | 50.0 |
| Perfume[2)] | 8.0 |
| GP-1[3)] | 1.5 |
| EB-21[4)] | 1.0 |

[1)]Mixture of caprylic and capric triglycerides, origin: Stepan
[2)]Perfume with a spicy note, item n° RAJW-0264YC-1, Origin: Firmenich SA, Geneva, Switzerland
[3)]Dibutyl lauroyl glutamide, origin: Ajinomoto Co., Tokyo, Japan
[4)]Dibutyl ethylhexanoyl glutamide, origin: Ajinomoto Co., Tokyo, Japan The sweet almond oil and Neobee® M 5 were added to a mixing vessel and heated to 90-110° C. GP-1 and EB-21 were premixed and then added with mixing until the powder was completely dissolved.

A transparent gel candle, Candle G, was then prepared from Base G. The base was cooled to 90-100° C. The perfume was then added to the cooled base. The obtained mixture was then poured into a suitable container. A wick was added. The candle was then cooled to ambient temperature.

The physical properties of the gel candle were then determined. The needle penetration, as measured using the ASTM D1321 method at 25° C., was of 230 mm A transmittance of 90.75% was measured with a ColorQuest XE spectrophotometer (origin: Hunter Lab) at 690 nm, using water as standard.

Example 8

Preparation of a Transparent Candle According to the Invention

A transparent gel candle base, Base H, was prepared by mixing the following ingredients in the amounts indicated.

TABLE 8

| composition of Base H | |
|---|---|
| Ingredient | Amount (%) |
| Sweet almond oil | 25.0 |
| Neobee ® M 5[1)] | 73.0 |
| GP-1[2)] | 1.0 |
| EB-21[3)] | 1.0 |

[1)]Mixture of caprylic and capric triglycerides, origin: Stepan
[2)]Dibutyl lauroyl glutamide, origin: Ajinomoto Co., Tokyo, Japan
[3)]Dibutyl ethylhexanoyl glutamide, origin: Ajinomoto Co., Tokyo, Japan The sweet almond oil and Neobee® M 5 were added to a mixing vessel and heated to 90-110° C. GP-1 and EB-21 were premixed and then added with mixing until the powder was completely dissolved.

A transparent gel candle, Candle H, was then prepared from Base H. The base was cooled to 90-100° C. and poured into a suitable container. A wick was added. The candle was then cooled to ambient temperature.

The physical properties of the gel candle were then determined. The needle penetration, as measured using the ASTM D1321 method at 25° C., was of 230 mm A transmittance of 91.12% was measured with a ColorQuest XE spectrophotometer (origin: Hunter Lab) at 690 nm, using water as standard.

Example 9

Preparation of a Transparent Candle According to the Invention

A transparent gel candle base, Base I, was prepared by mixing the following ingredients in the amounts indicated.

TABLE 9

| composition of Base I | |
|---|---|
| Ingredient | Amount (%) |
| Drakeol ® 19[1)] | 6.0 |
| Olive oil | 78.0 |
| Castor oil | 14.0 |
| GP-1[2)] | 1.2 |
| EB-21[3)] | 0.8 |

[1)]Mineral oil, USP Grade, origin: Penreco
[2)]Dibutyl lauroyl glutamide, origin: Ajinomoto Co., Tokyo, Japan
[3)]Dibutyl ethylhexanoyl glutamide, origin: Ajinomoto Co., Tokyo, Japan The Drakeol® 19, olive oil and castor oil were added to a mixing vessel and heated to 90-110° C. GP-1 and EB-21 were premixed and then added with mixing until the powder was completely dissolved.

A transparent gel candle, Candle I, was then prepared from Base I. The base was cooled to 90-100° C. and poured into a suitable container. A wick was added. The candle was then cooled to ambient temperature.

The physical properties of the gel candle were then determined. The needle penetration, as measured using the ASTM D1321 method at 25° C., was of 235 mm A transmittance of 89.76% was measured with a ColorQuest XE spectrophotometer (origin: Hunter Lab) at 690 nm, using water as standard.

Example 10

Preparation of a Transparent Candle According to the Invention

A transparent gel candle base, Base J, was prepared by mixing the following ingredients in the amounts indicated.

TABLE 10

| composition of Base J | |
|---|---|
| Ingredient | Amount (%) |
| Carnation ® oil[1)] | 35.0 |
| Safflower oil | 41.0 |
| Apricot oil | 22.8 |
| GP-1[2)] | 0.6 |
| EB-21[3)] | 0.6 |

[1)]Paraffin oil, origin: Sonneborn Inc., Mahwah, NJ, USA
[2)]Dibutyl lauroyl glutamide, origin: Ajinomoto Co., Tokyo, Japan
[3)]Dibutyl ethylhexanoyl glutamide, origin: Ajinomoto Co., Tokyo, Japan The paraffin oil, safflower oil and apricot oil were added to a mixing vessel and heated to 90-110° C. GP-1 and EB-21 were premixed and then added with mixing until the powder was completely dissolved.

A transparent gel candle, Candle J, was then prepared from Base J. The base was cooled to 90-100° C. and poured into a suitable container. A wick was added. The candle was then cooled to ambient temperature.

The physical properties of the gel candle were then determined. The needle penetration, as measured using the ASTM D1321 method at 25° C., was of 250 mm A transmittance of 92% was measured with a ColorQuest XE spectrophotometer (origin: Hunter Lab) at 690 nm, using water as standard.

Example 11

Preparation of a Transparent Candle According to the Invention

A transparent gel candle base, Base K, was prepared by mixing the following ingredients in the amounts indicated.

TABLE 11

| composition of Base K | |
|---|---|
| Ingredient | Amount (%) |
| Safflower oil | 27.7 |
| Apricot oil | 40.0 |
| Grapeseed oil | 9.9 |
| Isopar ™ V[1)] | 20.0 |
| GP-1[2)] | 1.2 |
| EB-21[3)] | 1.2 |

[1)]Isoparaffin, origin: ExxonMobil
[2)]Dibutyl lauroyl glutamide, origin: Ajinomoto Co., Tokyo, Japan
[3)]Dibutyl ethylhexanoyl glutamide, origin: Ajinomoto Co., Tokyo, Japan The safflower oil, apricot oil, grapeseed oil and Isopar™ V were added to a mixing vessel and heated to 90-110° C. GP-1 and EB-21 were premixed and then added with mixing until the powder was completely dissolved.

A transparent gel candle, Candle K, was then prepared from Base K. The base was cooled to 90-100° C. and poured into a suitable container. A wick was added. The candle was then cooled to ambient temperature.

The physical properties of the gel candle were then determined. The needle penetration, as measured using the ASTM D1321 method at 25° C., was of 176 mm A transmittance of 90% was measured with a ColorQuest XE spectrophotometer (origin: Hunter Lab) at 690 nm, using water as standard.

Example 12

Preparation of a Transparent Candle According to the Invention

A transparent gel candle base, Base L, was prepared by mixing the following ingredients in the amounts indicated.

TABLE 12

| composition of Base L | |
|---|---|
| Ingredient | Amount (%) |
| Safflower oil | 33.9 |
| Apricot oil | 50.0 |
| Grapeseed oil | 14.9 |
| GP-1[1)] | 0.6 |
| EB-21[2)] | 0.6 |

[1)]Dibutyl lauroyl glutamide, origin: Ajinomoto Co., Tokyo, Japan
[2)]Dibutyl ethylhexanoyl glutamide, origin: Ajinomoto Co., Tokyo, Japan The safflower oil, apricot oil and grapeseed oil were added to a mixing vessel and heated to 90-110° C. GP-1 and EB-21 were premixed and then added with mixing until the powder was completely dissolved.

A transparent gel candle, Candle L, was then prepared from Base L. The base was cooled to 90-100° C. and poured into a suitable container. A wick was added. The candle was then cooled to ambient temperature.

The physical properties of the gel candle were then determined. The needle penetration, as measured using the ASTM D1321 method at 25° C., was of 250 mm A transmittance of 92% was measured with a ColorQuest XE spectrophotometer (origin: Hunter Lab) at 690 nm, using water as standard.

Example 13

Preparation of a Transparent Candle According to the Invention

A transparent gel candle base, Base M, was prepared by mixing the following ingredients in the amounts indicated.

TABLE 13

| composition of Base M | |
|---|---|
| Ingredient | Amount (%) |
| Safflower oil | 27.7 |
| Apricot oil | 35.0 |
| Grapeseed oil | 9.9 |
| Isopar ™ V[1)] | 20.0 |
| Perfume[2)] | 5 |
| GP-1[3)] | 1.2 |
| EB-21[4)] | 1.2 |

[1)]Isoparaffin, origin: ExxonMobil
[2)]Perfume with a spicy note, item n° RAJW-0264YC-1, Origin: Firmenich SA, Geneva, Switzerland
[3)]Dibutyl lauroyl glutamide, origin: Ajinomoto Co., Tokyo, Japan
[4)]Dibutyl ethylhexanoyl glutamide, origin: Ajinomoto Co., Tokyo, Japan The safflower oil, apricot oil, grapeseed oil and Isopar™ V were added to a mixing vessel and heated to 90-110° C. GP-1 and EB-21 were premixed and then added with mixing until the powder was completely dissolved.

A transparent gel candle, Candle M, was then prepared from Base M. The base was cooled to 90-100° C. The perfume was then added to the cooled base. The obtained mixture was then poured into a suitable container. A wick was added. The candle was then cooled to ambient temperature.

Example 14

Preparation of a Transparent Candle According to the Invention

A transparent gel candle base, Base N, was prepared by mixing the following ingredients in the amounts indicated.

TABLE 14

| composition of Base N | |
|---|---|
| Ingredient | Amount (%) |
| Safflower oil | 36.0 |
| Apricot oil | 22.8 |
| Carnation ® oil[1)] | 30.0 |
| Perfume[2)] | 10.0 |
| GP-1[3)] | 0.6 |
| EB-21[4)] | 0.6 |

[1)]Paraffin oil, origin: Sonneborn Inc., Mahwah, NJ, USA
[2)]Perfume having a Vanilla note, item n° HGT3520-25B, origin: Firmenich SA, Geneva, Switzerland
[3)]Dibutyl lauroyl glutamide, origin: Ajinomoto Co., Tokyo, Japan
[4)]Dibutyl ethylhexanoyl glutamide, origin: Ajinomoto Co., Tokyo, Japan The safflower oil, apricot oil, and paraffin oil were added to a mixing vessel and heated to 90-110° C. GP-1 and EB-21 were premixed and then added with mixing until the powder was completely dissolved.

A transparent gel candle, Candle N, was then prepared from Base N. The base was cooled to 85-95° C. The perfume was then added to the cooled base. The obtained mixture was then poured into a suitable container. A wick was added. The candle was then cooled to ambient temperature.

Example 15

Preparation of a Transparent Candle According to the Invention

A transparent gel candle base, Base O, was prepared by mixing the following ingredients in the amounts indicated.

TABLE 15

| composition of Base O | |
|---|---|
| Ingredient | Amount (%) |
| Safflower oil | 30.9 |
| Apricot oil | 46.0 |
| Grapeseed oil | 14.9 |
| Perfume[1)] | 7.0 |
| GP-1[2)] | 0.6 |
| EB-21[3)] | 0.6 |

[1)]Perfume having a Vanilla note, item n° HGT3520-25B, origin: Firmenich SA, Geneva, Switzerland
[2)]Dibutyl lauroyl glutamide, origin: Ajinomoto Co., Tokyo, Japan
[3)]Dibutyl ethylhexanoyl glutamide, origin: Ajinomoto Co., Tokyo, Japan The safflower oil, apricot oil and grapeseed oil were added to a mixing vessel and heated to 90-110° C. GP-1 and EB-21 were premixed and then added with mixing until the powder was completely dissolved.

A transparent gel candle, Candle O, was then prepared from Base O. The base was cooled to 85-95° C. The perfume was then added to the cooled base. The obtained mixture was then poured into a suitable container. A wick was added. The candle was then cooled to ambient temperature.

Example 16

Preparation of a Transparent Candle According to the Invention

A transparent gel candle base, Base P, was prepared by mixing the following ingredients in the amounts indicated.

TABLE 16

| composition of Base P | |
|---|---|
| Ingredient | Amount (%) |
| Drakeol ® 19[1)] | 20.0 |
| Safflower oil | 27.7 |
| Apricot oil | 40.0 |
| Grapeseed oil | 10.3 |
| GP-1[2)] | 1.0 |
| EB-21[3)] | 1.0 |

[1)]Mineral oil, USP Grade, origin: Penreco
[2)]Dibutyl lauroyl glutamide, origin: Ajinomoto Co., Tokyo, Japan
[3)]Dibutyl ethylhexanoyl glutamide, origin: Ajinomoto Co., Tokyo, Japan The Drakeol® 19, safflower oil, apricot oil and grapeseed oil were added to a mixing vessel and heated to 90-110° C. GP-1 and EB-21 were premixed and then added with mixing until the powder was completely dissolved.

A transparent gel candle, Candle P, was then prepared from Base P. The base was cooled to 90-100° C. and poured into a suitable container. A wick was added. The candle was then cooled to ambient temperature.

The physical properties of the gel candle were then determined. The needle penetration, as measured using the ASTM D1321 method at 25° C., was of 230 mm A transmittance of 91% was measured with a ColorQuest XE spectrophotometer (origin: Hunter Lab) at 690 nm, using water as standard.

Example 17 (Comparative)

Preparation of a Transparent Candle Using Only Dibutyl Lauroyl Glutamide as Gelling Agent A transparent gel candle base, Base Q, was prepared by mixing the following ingredients in the amounts indicated.

TABLE 17

| composition of Base Q | |
|---|---|
| Ingredient | Amount (%) |
| Drakeol ® 19[1)] | 20.0 |
| Safflower oil | 27.7 |
| Apricot oil | 40.0 |
| Grapeseed oil | 10.3 |
| GP-1[2)] | 2.0 |

[1)]Mineral oil, USP Grade, origin: Penreco
[2)]Dibutyl lauroyl glutamide, origin: Ajinomoto Co., Tokyo, Japan The Drakeol® 19, safflower oil, apricot oil and grapeseed oil were added to a mixing vessel and heated to 90-110° C. GP-1 was then added with mixing until the powder was completely dissolved.

A transparent gel candle, Candle Q, was then prepared from Base Q. The base was cooled to 90-100° C. and poured into a suitable container. A wick was added. The candle was then cooled to ambient temperature.

The physical properties of the gel candle were then determined. The needle penetration, as measured using the ASTM D1321 method at 25° C., was of 300 mm A transmittance of 50% was measured with a ColorQuest XE spectrophotometer (origin: Hunter Lab) at 690 nm, using water as standard.

The gel candle obtained when only dibutyl lauroyl glutamide was used as gelling agent was not transparent. When compared to the candle of the invention as described in Example 16, the present candle also had a lower hardness. These two effects are due to the composition of the gelling agent since the oils used are the same and the respective concentrations of each oil and of the gelling agent are the same in both the candle of the invention of Example 16 and in the present candle, the preparation process being also the same.

Example 18 (Comparative)

Preparation of a Transparent Candle Using Only Dibutyl Ethylhexanoyl Glutamide as Gelling Agent A transparent gel candle base, Base R, was prepared by mixing the following ingredients in the amounts indicated.

TABLE 18

| composition of Base R | |
|---|---|
| Ingredient | Amount (%) |
| Drakeol ® 19[1)] | 20.0 |
| Safflower oil | 27.7 |
| Apricot oil | 40.0 |
| Grapeseed oil | 10.3 |
| EB-21[2)] | 2.0 |

[1)]Mineral oil, USP Grade, origin: Penreco
[2)]Dibutyl ethylhexanoyl glutamide, origin: Ajinomoto Co., Tokyo, Japan The Drakeol® 19, safflower oil, apricot oil and grapeseed oil were added to a mixing vessel and heated to 90-110° C. EB-21 was then added with mixing until the powder was completely dissolved.

A transparent gel candle, Candle R, was then prepared from Base R. The base was cooled to 90-100° C. and poured into a suitable container. A wick was added. The candle was then cooled to ambient temperature.

The physical properties of the gel candle were then determined. The needle penetration, as measured using the ASTM D1321 method at 25° C., was of 260 mm A transmittance of 50% was measured with a ColorQuest XE spectrophotometer (origin: Hunter Lab) at 690 nm, using water as standard.

The gel candle obtained when only dibutyl ethylhexanoyl glutamide was used as gelling agent was not transparent. When compared to the candle of the invention as described in Example 16, the present candle also had a lower hardness. These two effects are due to the composition of the gelling agent since the oils used are the same and the respective concentrations of the each oil and of the gelling agent are the same in both the candle of the invention of Example 16 and in the present candle, the preparation process being also the same.

The results of Examples 17 and 18 show that neither the use of dibutyl lauroyl glutamide alone, nor the use of dibutyl ethylhexanoyl glutamide alone provided a transparent candle, since both candles have a transmittance of only 50%. Based on these measurements, these two gelling agents appear to be unable to provide a transparent candle. Surprisingly, the transmittance measured for the candle of Example 16 shows that a synergistic effect is obtained when dibutyl lauroyl glutamide and dibutyl ethylhexanoyl glutamide are combined because a transparent candle is obtained.

Furthermore, it was observed that the hardness of the candle of the invention obtained in Example 16 was higher than that of both the candles of Examples 17 and 18, which were prepared with a single gelling agent. These examples therefore show a clear improvement of the hardness of the candle when a combination of dibutyl lauroyl glutamide and dibutyl ethylhexanoyl glutamide is used.

What is claimed is:

1. A self-supporting transparent gel candle base in the form of a gel composition comprising an oil, a perfume present in an amount of 5 to 15% by weight, relative to the total weight of the gel candle base, and a gelling agent comprising gelling effecting amounts of dibutyl lauroyl glutamide and dibutyl ethylhexanoyl glutamide.

2. The transparent gel candle base according to claim 1, which has a light transmittance of at least 80%, as measured spectrophotometrically at 690 nm using water as standard.

3. The transparent gel candle base according to claim 1, wherein the dibutyl lauroyl glutamide and dibutyl ethylhexanoyl glutamide, taken together, are present in an amount of from 0.5 to 10% by weight, relative to the total weight of the gel candle base.

4. The transparent gel candle base according to claim 1, wherein the dibutyl lauroyl glutamide and dibutyl ethylhexanoyl glutamide are present in a ratio of between 1:1 and 2.5:1.

5. The transparent gel candle base according to claim 1, wherein the oil is selected from the group consisting of hydrocarbon oils, vegetable oils, hydrogenated vegetable oils, petroleum derived oils, synthetic oils, phthalate esters and fatty acid esters.

6. The transparent gel candle base according to claim 1, wherein the oil is present in an amount of from 65% to 99.5% by weight, relative to the total weight of the gel candle base.

7. The transparent gel candle base according to claim 1, wherein the perfume contains at most 30% by weight, relative to the total weight of the perfume, of aromatic and primary alcohols.

8. The transparent gel candle base according to claim 1, having a needle penetration point measurement which is between 50 and 250 mm as measured using the ASTM D1321 method at 25° C.

9. The transparent gel candle base according to claim 1, having a melting point between 70 and 110° C.

10. A self-supporting transparent gel candle base in the form of a gel composition comprising an oil and a gelling agent comprising gelling effecting amounts of dibutyl lauroyl glutamide and dibutyl ethylhexanoyl glutamide, a perfume present in an amount of 5 to 15% by weight and at least one wick.

11. A self-supporting transparent gel candle base in the form of a gel composition comprising:

an oil in an amount of from 65% to 99.5% by weight, relative to the total weight of the gel candle base, with the oil selected from the group consisting of hydrocarbon oils, vegetable oils, hydrogenated vegetable oils, petroleum derived oils, synthetic oils, phthalate esters and fatty acid esters;

a perfume present in an amount of 5 to 15% by weight, relative to the total weight of the gel candle base; and a gelling agent comprising dibutyl lauroyl glutamide and dibutyl ethylhexanoyl glutamide which, taken together, are present in an amount of from 0.5 to 10% by weight, relative to the total weight of the gel candle base, and in a weight ratio of between 1:1 and 2.5:1;

wherein the candle base has a melting point between 70 and 110° C., a needle penetration point measurement which is between 50 and 250 mm as measured using the ASTM D1321 method at 25° C., and a light transmittance of at least 80%, as measured spectrophotometrically at 690 nm using water as standard.

12. The transparent gel candle base according to claim 11, wherein the perfume contains at most 30% by weight, relative to the total weight of the perfume, of aromatic and primary alcohols.

13. The transparent gel candle base according to claim 11, which further comprises at least one wick.

14. A method for the production of a self-supporting transparent gel candle base or self-supporting transparent candle which comprises incorporating in an oil a combination of dibutyl lauroyl glutamide and dibutyl ethylhexanoyl glutamide as a gelling agent for the candle base, and incorporating a perfume in an amount of 5 to 15% by weight, relative to the total weight of the gel candle base.

15. The method according to claim 14, which further comprises heating the oil to a temperature sufficient to solubilize the gelling agent therein.

16. The method according to claim 14, which further comprises:

cooling the base that include the solubilized gelling agent and oil to about 75-110° C.;

pouring the cooled base into a mold or container;

adding a wick; and cooling the wick containing base to ambient temperature to form the candle.

17. The transparent gel candle base according to claim 11, wherein the perfume contains at most 30% by weight, relative to the total weight of the perfume, of aromatic and primary alcohols.

18. The transparent gel candle base according to claim 1, which further comprises at least one wick.

19. The transparent gel candle base according to claim 1, wherein the perfume is present in an amount of greater than 5% by weight.

20. The transparent gel candle base according to claim 1, wherein the perfume is present in an amount of at least 7% by weight.

* * * * *